United States Patent [19]

Tsuneda

[11] 3,998,746

[45] Dec. 21, 1976

[54] LIQUID DEVELOPER COMPRISING HEAT TREATED RUBBER FOR USE IN DEVELOPMENT OF AN ELECTROSTATIC LATENT IMAGE AND METHOD OF MAKING DEVELOPER

[75] Inventor: Terukuni Tsuneda, Yokohama, Japan

[73] Assignee: Canon Kabushiki Kaisha, Tokyo, Japan

[22] Filed: Oct. 31, 1974

[21] Appl. No.: 519,768

[30] Foreign Application Priority Data

Nov. 5, 1973 Japan ..... 48-124284

[52] U.S. Cl. ..... 252/62.1 L; 106/308 M; 260/42.54

[51] Int. Cl.[2] ..... G03G 9/12

[58] Field of Search ..... 252/62.1 L; 260/42.54; 106/308 M

[56] References Cited

UNITED STATES PATENTS

| | | | |
|---|---|---|---|
| 3,078,231 | 2/1963 | Metcalfe et al. | 252/62.1 L |
| 3,640,863 | 2/1972 | Okuno | 252/62.1 L |
| 3,657,130 | 4/1972 | Machida et al. | 252/62.1 L |
| 3,668,127 | 6/1972 | Machida et al. | 252/62.1 L |
| 3,766,072 | 10/1973 | Metcalfe et al. | 252/62.1 |
| 3,843,538 | 10/1974 | Vermeulen et al. | 252/62.1 L |

*Primary Examiner*—Mayer Weinblatt
*Assistant Examiner*—John D. Smith
*Attorney, Agent, or Firm*—Fitzpatrick, Cella, Harper & Scinto

[57] ABSTRACT

A liquid developer for an electrostatic latent image according to the present invention comprises an insulating carrier liquid containing therein a dispersed toner composed of colored particles coated with at least one rubber selected from the group consisting of natural rubber, styrene-butadiene rubber and vinyltoluene-butadiene rubber, each of the rubber components having been subjected to a heat treatment at a temperature not lower than 150° C prior to being coated on said colored particles.

19 Claims, No Drawings

LIQUID DEVELOPER COMPRISING HEAT TREATED RUBBER FOR USE IN DEVELOPMENT OF AN ELECTROSTATIC LATENT IMAGE AND METHOD OF MAKING DEVELOPER

BACKGROUND OF THE INVENTION

1. Field of the Invention

The present invention relates to a liquid developer for use in the development of an electrostatic latent image in the fields of electrophotography, electrostatic printing and the like.

2. Description of the Prior Art

Various liquid developers of the prior art which have been used for developing an electrostatic latent image are composed of pigment particles and an additive such as resins and the like, both of which are dispersed in a highly insulating carrier liquid having an electric resistivity not lower than $10^9$ ohm cm and a dielectric constant not higher than 3. In the carrier liquid, the pigment particles adsorb the resins and the like to form a toner. The additive, for example the resin, serves to control the polarity of the pigment particles and improve the dispersibility thereof in the carrier liquid and the fixing property of the toner.

The known liquid developers have been prepared for example, by kneading the pigment particles (such as) carbon black and the like) along with a polarity controlling agent, a dispersing agent and a fixing agent, for example, vegetable oil such as linseed oil, soybean oil and the like, and resins such as an alkyd resin, polystyrene, an acrylic acid type resin and the like to finely granulate the kneaded mixture, followed by dispersion of the granules into the carrier liquid such as an organic solvent, for example, a paraffin type hydrocarbon and the like. In the case of such a liquid developer, the additive other than the pigment particles is generally of a very excellent dissolving property in the carrier liquid, and therefore, it is liable to desorb and separate from the pigment particles during the use of the liquid developer and the storage thereof for a long period of time to thereby deteriorate the chargeability or polarity, dispersibility and fixing property of the toner. As a consequence of the foregoing, it becomes impossible to use the liquid developer in practice. This is one of the greatest defects of such a liquid developer. As the toner of the liquid developer prepared so as to eliminate such defects, there has been known, for example, a graft carbon type toner in which carbon black is directly and chemically bonded with the particular resins contributing to the polarity control and dispersibility of the corbon black to improve the bond therebetween. However, since the toner materials of such graft copolymer, that is, the pigment and resin are combined with each other by a chemical reaction, the respective kinds are strictly restricted within such a range that the chemical reaction is able to take place. Even when the reaction is performed under a constant condition, it is difficult to always form a product of constant quality. Due to these facts, unreacted materials and various undesired by-products may get mixed with the liquid developer to decrease the developing property of the toner and cause the deterioration phenomena thereof.

In addition, it has been known that natural rubber and synthetic rubber are used as an additive to the pigment, or as a material of the graft-copolymer. Generally, such natural rubber and synthetic rubber are dissolved in a solvent and kneaded along with the pigment, followed by dispersion of the kneaded mixture in the carrier liquid to coat the coloring particles with the natural rubber and synthetic rubber. In this case, however, there is such a defect that the developing property of the toner thus obtained is remarkably deteriorated by a considerable amount of elution of the resin and rubber constituting the toner particles in the carrier liquid, the desorption thereof from the toner particles, the flocculation of the toner particles and the loss of the balance of the toner composition due to the increase in the dissolving materials in the carrier liquid.

SUMMARY OF THE INVENTION

It is therefore an object of the present invention to provide a liquid developer for an electrostatic latent image which is free from the above-mentioned defects.

It is another object of the present invention to provide a liquid developer for an electrostatic latent image which is free from the desorption of the resins from the pigment particles and is excellent in its storage stability and dispersion stability.

It is a further object of the present invention to provide a liquid developer for an electrostatic latent image which is capable of forming copies of a high image density and which are free of fog due to the excellent chargeability of the toner particles.

It is still another object of the present invention to provide a liquid developer for an electrostatic latent image which is excellent in its fixing property.

According to the present invention, there is provided a liquid developer for an electrostatic latent image which comprises an insulating carrier liquid containing dispersed therein a toner composed of colored particles coated with at least one of natural rubber, styrene-butadiene rubber, and vinyltoluene-butadiene rubber, each of the rubber components having subjected to a heat treatment at a temperature not lower than 150° C prior to being coated on the colored particles.

According to another aspect of the present invention, there is provided a liquid developer for an electrostatic latent image which comprises the above-mentioned liquid developer for an electrostatic latent image and a polarity controlling agent.

DESCRIPTION OF THE PREFERRED EMBODIMENTS

The present inventor has found that when the toner containing the pigment particles coated with at least one carrier liquid-soluble natural rubber, styrene-butadiene rubber or vinyltoluene-butadiene rubber which has been dissolved in a solvent, subjected to heat treatment at a temperature of 150° C or more and cooled to room temperature is dispersed in a carrier liquid to prepare a liquid developer, a toner is obtained which is extremely improved in its dispersion stability, storage stability, fixing property and chargeability, and free from the desorption of the rubber from the pigment particles.

The natural rubber, styrene-butadiene rubber and vinyltoluene-butadiene rubber used in the present invention may be usually subjected to heat treatment at a temperature not lower than 150° C and not higher than a decomposition temperature of the above-mentioned rubbers for 10 minutes or more.

The viscosity of the rubber solution increases in proportion to the heating temperature and the period of time of the heat treatment. The rubbers of the most desired properties in the present invention are those obtained under the following heat treatment condition: a heating temperature of from 150° to 200° C, preferably of from 160° to 180° C, and a heating period of time of from 10 to 60 minutes, preferably of from 15 to 30 minutes. It is considered that the thermosetting property possessed by the natural rubber, styrene-butadiene rubber and vinyltoluene-butadiene rubber is accelerated by the above-mentioned heat treatment and these rubbers are modified to those having the most desired properties required as a toner composition. As the solvent used preferably for the heat treatment of the natural rubber, styrene-butadiene rubber and vinyltoluene butadiene rubber, there may be mentioned aliphatic hydrocarbons of a boiling point ranging from 150° C to 200° C, preferably 160° C to 180° C. The thus treated rubbers may be kneaded along with pigment particles and dispersed in a carrier liquid. In the preparation of the liquid developer of the present invention, the natural rubber, styrene-butadiene rubber and vinyltoluene-butadiene rubber thus treated by heating is used usually in an amount of 1 to 200 parts by weight, preferably 5 to 50 parts by weight thereof per 100 parts by weight of the pigment particles or coloring particles of the toner. If necessary, it is preferred to disperse a polarity controlling agent conventionally used for a liquid developer in the carrier liquid to improve the chargeability of the toner.

The colored particles to be used in the present invention may be those prepared by kneading pigment or dye along with resins, followed by pulverization thereof.

As the coloring particles to be used in the present invention, there may be mentioned the so far known dyes and pigments, for example,

| | |
|---|---|
| Fanal Pink (C.I.45160)<br>Heliogen Blue (C.I.74100) | (Trade names for the products of Badische Anilin & Soda Fabrik A.G.) |
| Rhodamine B (C.I.45170) | (Trade name for the product of Du Pont) |
| Victoria Blue LAKE (C.I.42595 LAKE) | (Trade name for the product of Daido Kasei K.K.) |
| Lionogen Magenta R (C.I.46500) | (Trade name for the product of Toyo Ink K.K.) |
| Cromophtal Blue 4G (C.I.74160) | (Trade name for the product of Ciba Ltd.) |
| Seikafast Carmine 6B 1480 (C.I.15850)<br>Seikalight Rose R-40 (C.I.45160)<br>Seikalight Blue 2B 615 (C.I.74200)<br>Cromofine Blue 4950 (C.I.74160)<br>Seikafast Yellow H7055 (C.I.21090)<br>Seikafast Yellow 7045 (C.I.21094)<br>Seikafast Yellow GT-2400 (C.I.21105) | (Trade names for the products of Dainichi Seika K.K.) |

As examples of carbon black are as follows:

| | |
|---|---|
| Mogul A<br>Elftex 5<br>Elfvulcan XC | (Trade names for the products of Godfrey, L, Cabot Co., U.S.A.) |
| Statex | (Trade name for the product of Columbia Carbon Co., U.S.A.) |
| Carbon Black XC-550 | (Trade name for the product of Asahi Carbon K.K.) |
| Carbon Black Mitsubishi No. 44<br>Carbon Black Mitsubishi No. 100 | (Trade names for the products of Mitsubishi Kasei Kogyo K.K.) |

Among the resins to be kneaded along with the above-listed pigments and dyes to prepare the coloring particles are included a polyvinyl chloride resin, a polyvinylidene chloride resin, a copolymer of vinyl chloride and vinylidene chloride, chlorinated polypropylene, a copolymer of vinyl chloride and vinyl acetate, a copolymer of vinyl chloride, vinyl acetate and maleic anhydride, ethyl cellulose, nitro cellulose, a polyacrylic ester resin, a linseed oil modified alkyd resin, a rosin modified alkyd resin, a phenol modified alkyd resin, a phenolic resin, a polyester resin, a polyvinyl butyral resin, a polyisocyanate resin, a polyurethane resin, a polyvinyl acetate resin, a polyamide resin, a cumarone resin, a dammar resin, a ketone resin, a maleic acid resin, a polyethylene or low molecular weight, a polystyrene resin, a phenol modified pentaerythritol ester of rosin, and cellophonium. In particular, from the above enumerated resins, those having a softening point of from 50° C to 130° C and being insoluble in the carrier liquid are preferably selected for use in the present invention.

The polarity controlling agent to be used in the present invention along with the heat-treated natural rubber, styrene-butadiene rubber and/or vinyltoluene-butadiene rubber is as follows:

Phospholipids such as lecithin, cephalin and the like;

Alanines having a long chain alkyl group of 8 to 20 carbon atoms;

Metal soaps such as manganese naphthenate, cobalt naphthenate, aluminium naphthenate, nickel naphthenate, zinc naphthenate, iron naphthenate, and the like;

Zirconium salts of fatty acids having an alkyl group of 8 to 20 carbon atoms;

Alkylbenzene sulfonates having an alkyl group of 8 to 20 carbon atoms (the salts are those of Na, Ca, Mg, K, Al, Zn, Ba and the like);

Dialkyl sulfosuccinates having an alkyl group of 8 to 20 carbon atoms (the salts are those of Na, Ca, Mg, K, Al, Zn, Ba and the like);

Dialkyl naphthalene suflonates having an alkyl group of 8 to 20 carbon atoms (the salts are those of Na, Ca, Mg, K, Al, Zn, Ba and the like);

Polyoxyethylene sulfates having an alkyl group of 8 to 20 carbon atoms (the salts are those of Na, Ca, Mg, K, Al, Zn, Ba and the like;

Dialkyl phosphates having an alkyl group of 8 to 20 carbon atoms (the salts are those of Na, Ca, Mg, K, Al, Zn, Ba and the like);

Vegetable oils such as soybean oil, linseed oil, boiled linseed oil, chinese wood oil, tall oil, safflower oil, castor oil, poppy oil, peanut oil and the like.

The amount of the polarity controlling agent used in the present invention varies depending upon the property thereof, but usually it is used in an amount of from 0.002g to 10g, preferably from 0.002g to 1.0g, per one liter of the carrier liquid in the liquid developer.

As the carrier liquid to be used in the present invention, an electrically insulating liquid which has been used for a liquid developer for an electrostatic latent image may be used, but an insulating liquid possessing an electric resistivity not lower than $10^9$ ohm-cm and a dielectric constant not higher than 3 is preferably used for the carrier liquid in the present invention. Among them are included aliphatic hydrocarbons, aromatic hydrocarbons, halogenated hydrocarbons and the like. For example, there may be mentioned n-pentane, cyclohexane, isoparaffin, halogenated paraffin, naphtha, kerosene, light oil and the like.

As the solvents to be used in the present invention for the heat treatment of the natural rubber, styrene-butadiene rubber and vinyltoluene-butadiene rubber, those of a boiling point ranging from 150° C to 200° C, preferably 160° C to 180° C are selected from the above-enumerated carrier liquids. The solvents preferably used are as follows:

| | |
|---|---|
| Idemitsu Solvent IP 1620 (161–190° C)<br>Idemitsu Solvent IP 2025 (201–258° C) | (Trade names for the products of Idemitsu Sekiyu Kagaku K.K.) |
| Esso Naphtha No. 3 (85–124° C)<br>Esso Naphtha No. 5 (152–197° C)<br>Esso Naphtha No. 6 (152–197° C)<br>Esso Rubber Solvent (85–124° C)<br>Special Solvent Kerosene (203–260° C)<br>Isopar E (115–142° C)<br>Isopar G (158–177° C)<br>Isopar H (174–189° C)<br>Isopar L (188–210° C)<br>Isopar M (207–257° C) | (Trade names for the products of Esso Standard Oil Co.) |

Note: The numerical values in the parentheses after the trade names represent the respective boiling point ranges.

Any natural rubber, styrene-butadiene rubber and vinyltoluene-butadiene rubber can be used in the present invention as far as these rubbers are capable of being dissolved in the carrier liquid of a boiling point ranging from 150° C to 200° C as mentioned above. In particular, with respect to the styrene-butadiene rubber and vinyltoluene-butadiene rubber, the copolymers containing 5–40% by weight of styrene and vinyltoluene, respectively, preferably 10–30% by weight are desired.

As the examples of the styrene-butadiene rubber and vinyltoluene-butadiene rubber to be used in the present invention, there may be mentioned Solprene 1204, Solprene 1205, Solprene 1206, Solprene 306, Solprene 375, Solprene 376, Solprene 377, Solprene 380 (each of these are trade names for the products of Asahi Kasei Kogyo K.K.), Vistanex LM, Vistanex MN, Esso Vistalon 4504, Esso Vistalon 4608 (these are trade names for the products of Esso Standard Oil Co.) and the like.

The following examples are given as illustrative of the invention, but it will be understood that the invention is not limited thereto.

EXAMPLE 1

A mixture of the following components was kneaded with a roll mill for 30 minutes to sufficiently disperse the pigment in the whole mixture.

| | |
|---|---|
| Carbon Black (Elftex, trade name for the product of Cabot Co.) | 40 g |
| Polyester resin (XPL 2005, trade name for the product of Kao Atlas Co.) | 240 g |

and 400 ml of Isopar H (Trade name for the isoparaffin type hydrocarbon of Esso Standard Oil Co.) were dispersed for 15 hours to obtain a dispersion material coarsely ground.

A solution of the following components was subjected to heat treatment at 170° C for 15 minutes to prepare an adhesive material.

| | |
|---|---|
| A block copolymer of styrene and butadiene (Solprene 1205, trade name for the product of Asahi Kasei K.K.) | 30 g |
| Isopar H (Isoparaffin type hydrocarbon supplied by Esso Standard Oil Co., | 120 g |

-continued

| |
|---|
| the boiling point range: 174–189° C) |

The resulting adhesive material was mixed with the foregoing coarsely ground material and kneaded with a ball mill for 40 hours to prepare a concentrated toner liquid.

For the comparison, the same solution of Solprene 1205 and Isopar H as mentioned above, which was not subjected to the heat treatment, was mixed with the foregoing coasely ground material and further kneaded with a ball mill for 40 hours to prepare a comparative concentrated toner liquid.

On the other hand, a dispersion solution composed of 100g of a finely crystallized cadmium sulfide, 10g of a solution of a vinyl chloride and vinyl acetate copolymer in 50% toluene and 80g of toluene was applied to an aluminum foil of 0.05 mm in thickness in order that the coating might become 40 microns in thickness after drying. A polyester film of 38 microns in thickness was adhered onto the coating with an epoxy resin adhesive of a normal temperature setting type to produce a three-layered photosensitive member of a three layered structure. The photosensitive member was subjected to corona charging at +7KV, and subsequently to AC corona charging at 7KV simultaneously with an image exposure, and the whole surface of the photosensitive member was uniformly exposed to form an electrostatic latent image. The latent image was developed with the liquid developer of the present invention which was prepared in such a manner that 30 ml of the foregoing concentrated toner liquid was dispersed in 1000ml of Isopar H solution containing 20 mg of lecithin as a polarity controlling agent, whereby a positive image was obtained. On the other hand, the foregoing latent image was also developed with a comparative liquid developer prepared in the same manner as using the foregoing comparative concentrated toner liquid, thereby obtaining a positive image. A transfer paper was brought into contact with each of these developed positive images and subjected to charging at +6KV and the transfer paper was peeled off so that the image was transferred to the paper.

The comparison results in the above experiment with respect to the properties of the liquid developer and the comparative liquid developer are as shown in the following table.

| | Immediately after the preparation of the liquid developer | | After the storage of the liquid developer for one month | |
|---|---|---|---|---|
| | Image density | Fixing property | Image density | Fixing property |
| Liquid developer (heat treatment) | 1.2 | Perfect fixation | 1.15 | Perfect fixation |
| Comparative liquid developer (no heat treatment) | 0.8 | Fair fixing | 0.65 | Poor fixation |

The results with respect to the liquid developer which was prepared by changing only the heat treatment condition for the styrene-butadiene rubber in the foregoing experiment are as shown below.

| Heat treatment condition | Immediately after the preparation of the liquid developer | | After the storage of the liquid developer for one month | |
|---|---|---|---|---|
| | Image density | Fixing property | Image density | Fixing property |
| 200° C for 10 minutes | 1.15 | Perfect fixation | 1.10 | Perfect fixation |
| 150° C for 30 minutes | 1.20 | Perfect fixation | 1.17 | Perfect fixation |

EXAMPLE 2

Liquid developers were prepared in the same manner as in Example 1 except that natural rubber and vinyltoluene-rubber were separately used in place of Solprene 1205 constituting the liquid developer prepared in Example 1. The comparison experiment was carried out in the same manner as in Example 1 to obtain substantially the same results.

EXAMPLE 3

Liquid developers were prepared in the same manner as in Example 1 except that Solprene 1204 and Solprene 376 were separately used as the styrene-butadiene rubber in place of Solprene 1205. The obtained liquid developers were subjected to the same comparison experiment as that in Example 1 to obtain results which were substantially the same as those in Example 1.

EXAMPLE 4

In place of Isopar H used in Example 1 as the solvent for the heat treatment and as the carrier liquid for the styrene-butadiene rubber, the under-listed solvents were used to prepare liquid developers in the same manner as in Example 1. The results of the comparison experiment conducted in the same manner as in Example 1 are shown in the following table.

| Solvent for heat treatment | Carrier liquid | Immediately after the preparation of the liquid developer | | After the storage of the liquid developer for one month | |
|---|---|---|---|---|---|
| | | Image density | Fixing property | Image density | Fixing property |
| Idemitsu Solvent 1P1620 | same as solvent | 1.15 | Perfect fixation | 1.12 | Perfect fixation |
| Idemitsu Solvent 1P2025 | " | 1.10 | " | 1.10 | " |
| Esso Naphtha No.5 | " | 1.20 | " | 1.15 | " |
| Esso Naphtha No.6 | " | 1.10 | " | 1.10 | " |
| Isopar L | " | 1.10 | " | 1.10 | " |

-continued

| Solvent for heat treatment | Carrier liquid | Immediately after the preparation of the liquid developer: Image density | Fixing property | After the storage of the liquid developer for one month: Image density | Fixing property |
|---|---|---|---|---|---|
| Isopar M | " | 1.15 | " | 1.10 | " |

The results of the experiment with respect to the comparative liquid developers prepared without the heat treatment of the above-enumerated solvents are as shown below.

| Solvent | Carrier liquid | Immediately after the preparation of the liquid developer: Image density | Fixing property | After the storage of the liquid developer for one month: Image density | Fixing property |
|---|---|---|---|---|---|
| Idemitsu Solvent 1P1620 | Same as Solvent | 0.90 | Fair fixation | 0.70 | Poor fixation |
| Idemitsu Solvent 1P2025 | " | 0.85 | " | 0.68 | " |
| Esso Naphtha No. 5 | " | 0.91 | " | 0.65 | " |
| Esso Naphtha No. 6 | " | 0.87 | " | 0.71 | " |
| Isopar L | " | 0.90 | " | 0.65 | " |
| Isopar M | " | 0.90 | " | 0.70 | " |

EXAMPLE 5

A mixture of the following components was kneaded with a roll mill for 30 minutes to sufficiently disperse the pigment in the whole mixture.

| | |
|---|---|
| Phthalocyanine type blue organic pigment (C.I.74160) (Heliogen Blue 7080, tradename for the product of BASF) | 50g |
| Styrene-indene-acrylonitrile copolymer (Piccoflex 100 resin, tradename for the product of Pennsylvania Chemical Industry Co.) | 300g |

With a ball mill, 150g of the above dispersed mixture and 400 ml of Isopar H (tradename for the product of Esso Standard Oil Co.) were dispersed for 15 hours to obtain a coarsely ground dispersion material.

The same styrene-butadiene rubber solution as that in Example 1 which was subjected to the heat treatment was used to prepare a concentrated toner liquid in the same manner. On the other hand, a comparative concentrated toner liquid was prepared by using the same styrene-butadiene rubber solution which was not subjected to the heat treatment. In place of the lecithin used in Example 1, 40 mg of dioctyl calcium sulfosuccinate was used to prepare a liquid developer of the present invention and a comparative liquid developer. The comparison experiment was conducted in the same manner as in Example 1 to obtain the results as shown below.

| | Immediately after the preparation of the liquid developer: Image density | Fixing property | After the storage of the liquid developer for one month: Image density | Fixing Property |
|---|---|---|---|---|
| Liquid Developer (heat treatment) | 1.15 | Perfect fixation | 1.13 | Perfect Fixation |
| Comparative liquid developer (no heat treatment) | 0.75 | " | 0.60 | Poor fixation |

EXAMPLE 6

In Example 5, Fanal Pink SM4830 (tradename for the product of BASF) and a polystyrene resin (Piccolastic, tradename for the product of Esso Standard Oil Co.) were used in place of Heliogen Blue 7080 and the styrene-indene-acrylonitrile copolymer, respectively, to carry out the comparison experiment. The results obtained were substantially the same as those in Example 5.

EXAMPLE 7

In Example 5, Neo Fast Pink (tradename for the product of Daido Kasei K.K.) and Piccoflex 520 (tradename for the styrene-indene-acrylonitrile copolymer of Pennsylvania Chemical Industry Co.) were used in place of Heliogen Blue 7080 and Piccoflex 100 Resin, respectively. The comparison experiment was conducted in the same manner as in Example 5 to obtain substantially the same results.

EXAMPLE 8

In Example 5, Lionogen Magenta R (tradename for the product of Toyo Ink Kogyo K.K.) and Piccolastic D-100 (tradename for the polystyrene resin of Esso Standard Oil Co.) were used in place of Heliogen Blue 7080 and Piccoflex 100 Resin, respectively. The comparison experiment was carried out in the same manner as that in Example 5 to obtain substantially the same results.

EXAMPLE 9

In Example 5, Cromo Phtal Blue 4G (tradename for the product of Ciba Co.) and Eslec B (tradename for the butyral resin of Sekisui Kagaku Kogyo K.K.) were used in place of Heliogen Blue 7080 and Piccoflex 100 Resin, respectively, to carry out the comparison experiment in the same manner as that in Example 5. The results of the comparison experiment were substantially the same.

EXAMPLE 10

In Example 5, Seikafast Carmine 6B1480 (tradename for the product of Dainichi Seika K.K.) and Super Beckacite 2100 (tradename for the phenolic resin of Nippon Reichhold K.K.) were used instead of Heliogen Blue 7080 and Piccoflex 100 Resin, respectively, to conduct the comparison experiment in the same manner as in Example 5. The results of the comparison experiment were substantially the same.

EXAMPLE 11

In Example 5, Cromofine Blue 4950 (tradename for the product of Dainichi Seika K.K.) and Pentacite P423 (tradename for the natural resin modified pentaerythritol resin of Nippon Reichhold K.K.) were in place of Heliogen Blue 7080 and Piccoflex 100 Resin, respectively. The results of the comparison experiment conducted in the same manner as in Example 5 were substantially the same.

EXAMPLE 12

In Cephalin of phospholipid was used in place of lecithin used as the polarity controlling agent of the toner in Example 1 to conduct the comparison experiment in the same manner. The results were substantially the same as those in Example 1.

EXAMPLE 13

Each of the under-enumerated salts of dioctyl sulfosuccinate was used as the polarity controlling agent in the procedure of Example 5 to obtain the results as shown below.

| | Immediately after the preparation of the liquid developer | | After the storage of the liquid developer for one month | |
|---|---|---|---|---|
| Salt | Image density | Fixing property | Image density | Fixing property |
| Na | 1.15 | Perfect fixation | 1.15 | Perfect fixation |
| K | 1.2 | " | 1.15 | " |
| Mg | 1.10 | " | 1.10 | " |
| Al | 1.15 | " | 1.12 | " |
| Zn | 1.0 | " | 1.0 | " |
| Ba | 1.0 | " | 1.0 | " |

EXAMPLE 14

In place of the dioctyl calcium sulfosuccinate used as the polarity controlling agent in Example 5, 50 mg of calcium dinonyl naphthalenesulfonate was used to carry out a comparison experiment in the same manner. The results obtained were substantially the same as those in Example 5.

EXAMPLE 15

Each of the under-enumerated salts of sulfonic acid was used in place of the calcium dinonyl naphthalenesalfonate used in Example 14 to obtain the following results.

| | Immediately after the preparation of the liquid developer | | After the storage of the liquid developer for one month | |
|---|---|---|---|---|
| Salt | Image density | Fixing Property | Image density | Fixing property |
| Na | 1.2 | Perfect fixation | 1.18 | Perfect fixation |
| K | 1.2 | " | 1.19 | " |
| Mg | 1.1 | " | 1.1 | " |
| Al | 1.0 | " | 1.0 | " |
| Zn | 1.0 | " | 1.0 | " |
| Ba | 1.0 | " | 1.0 | " |

EXAMPLE 16

Calcium dodecylbenzenesulfonate was used in place of the dioctyl calcium sulfosuccinate used as the polarity controlling agent in Example 5 to carry out a comparison experiment in the same manner as in Example 5. The results were substantially the same.

EXAMPLE 17

Following the procedure of Example 5, the under-enumerated salts of dodecylbenzenesulfonic acid were used in place of the calcium dioctyl sulfosuccinate, to obtain the results as shown below.

| | Immediately after the preparation of the liquid developer | | After the storage of the liquid developer for one month | |
|---|---|---|---|---|
| Salt | Image density | Fixing Property | Image density | Fixing property |
| Na | 1.16 | Perfect fixation | 1.15 | Perfect fixation |
| K | 1.2 | " | 1.2 | " |
| Mg | 1.0 | " | 1.0 | " |
| Al | 1.1 | " | 1.0 | " |
| Zn | 1.0 | " | 1.0 | " |
| Ba | 1.0 | " | 1.0 | " |

EXAMPLE 18

The concentrated toner liquid and the comparative concentrated toner liquid as prepared in Example 1 were used, and 30 ml of these solutions were separately dispersed in 1000ml of Isopar H. 30 mg of cobalt naphthenate was dissolved in each of these mixtures in place of the lecithin used in Example 1 as the polarity controlling agent to prepare a positive type liquid developer and a comparative liquid developer.

On the other hand, a mixture of 100 g of a finely crystallized zinc oxide, 20 g of a solution of a styrene-butadiene copolymer in 50% toluene, 40g of a solution of n-butyl acrylate in 50% toluene, 120g of toluene and 4 ml of a solution of Rose Bengal in 1% methanol was dispersed with a ball mill for 6 hours. The dispersed mixture was applied onto a paper to which an undercoating treatment was previously applied to obtain a coating having a dry thickness of 20 microns after the drying, was prepared. The sensitive paper was subjected to corona charging at −6KV, and subsequently to an image exposure to form an electrostatic latent image. The latent image was immersed in the above-mentioned liquid developer and the comparative liquid developer to develop a positive image and the results as shown below were obtained.

| | Immediately after the preparation of the liquid developer | | After the storage of the liquid developer for one month | |
|---|---|---|---|---|
| | Image density | Fixing property | Image density | Fixing property |
| Liquid developer | 1.2 | Perfect fixation | 1.15 | Perfect fixation |
| Comparative liquid developer | 0.85 | Fair fixation | 0.8 | Poor fixation |

EXAMPLE 19

The under-enumerated salts of naphthenic acid were used in place of the cobalt naphthenate used as the polarity controlling agent in Example 18 to obtain the following results.

| | Immediately after the preparation of the liquid developer | | After the storage of the liquid developer for one month | |
|---|---|---|---|---|
| Salt of naphthenic acid | Image density | Fixing property | Image density | Fixing property |
| Mg | 1.15 | Perfect fixation | 1.15 | Perfect fixation |
| Al | 1.2 | & " | 1.18 | & " |
| Pb | 1.1 | " | 1.0 | " |
| Zn | 1.0 | " | 0.9 | " |
| Fe | 1.0 | " | 0.9 | " |

EXAMPLE 20

A comparison experiment was carried out in the same manner as in Example 5 except that soybean oil was used in place of the dioctyl calcium sulfosuccinate used as the polarity controlling agent to obtain substantially the same results as those in Example 5.

I claim:

1. A liquid developer for electrophotography consisting essentially of a toner dispersed in an electrically-insulating carrier liquid, said toner consisting essentially of colored particles coated with a rubber selected from the group consisting of natural rubber, styrene-butadiene rubber and vinyltoluene-butadiene rubber, said rubber having been subjected to a heat-treatment in a solvent at a temperature of at least 150° C. for a period of time of at least 10 minutes. Prior to being coated on said colored particles.

2. A liquid developer according to claim 1, further consisting essentially of a polarity controlling agent.

3. A liquid developer according to claim 1, in which the heat treatment is conducted at a temperature of 150° to 200° C for 10 to 60 minutes.

4. A liquid developer according to claim 1, in which the heat treatment is conducted at a temperature of 160° to 180° C for 15 to 30 minutes.

5. A liquid developer according to claim 1, in which the rubber is dissolved in a solvent which has a boiling point of 150° to 200° C, followed by a heat treatment conducted at a temperature of 150° to 200° C for 10 to 60 minutes.

6. A liquid developer according to claim 1, in which the rubber is styrene-butadiene rubber having 5 to 40 percent by weight of the styrene.

7. A liquid developer according to claim 1, in which the rubber is styrene-butadiene rubber having 10 to 30 percent by weight of the styrene.

8. A liquid developer according to claim 1, in which the rubber is vinyltoluene-butadiene rubber having 5 to 40 percent by weight of the vinyltoluene.

9. A liquid developer according to claim 1, in which the rubber is vinyltoluene-butadiene rubber having 10 to 30 percent by weight of the vinyltoluene.

10. A liquid developer according to claim 1, in which said toner is composed of from 1 to 200 parts by weight of rubber per 100 parts by weight of the colored particles.

11. A liquid developer according to claim 1, in which said toner is composed of from 5 to 50 parts by weight of rubber per 100 parts by weight of the colored particles.

12. A liquid developer according to claim 2, in which the polarity controlling agent is selected from the group consisting of a phospholipid, an alkyl alanine having a long chain alkyl group of 8 to 20 carbon atoms, manganese naphthenate, colbàlt naphthenate, aluminum naphthenate, nickel naphthenate, zinc naphthenate, iron naphthenate, a zirconium salt of fatty acids having an alkyl group of 8 to 20 carbon atoms, a metal salt of an alkylbenzene sulfonic acid having an alkyl group of 8 to 20 carbon atoms, a metal salt of a dialkyl sulfosuccinic acid having an alkyl group of 8 to 20 carbon atoms, a metal salt of a dialkyl naphthalene sulfonic acid having an alkyl group of 8 to 20 carbon atoms, a metal salt of a polyoxyethylene sulfuric acid having an alkyl group of 8 to 20 carbon atoms, a metal salt of a dialkyl phosphoric acid having an alkyl group of 8 to 20 carbon atoms, soybean oil, linseed oil, boiled linseed oil, chinese wood oil, tall oil, safflower oil, castor oil, poppy oil, and peanut oil.

13. A liquid developer according to claim 2, in which the developer contains the polarity controlling agent in an amount of 0.002 to 10 g thereof per one liter of the carrier liquid.

14. A liquid developer according to claim 2, in which the developer contains the polarity controlling agent in an amount of 0.002 to 1.0g thereof per one liter of the carrier liquid.

15. A liquid developer according to claim 5, in which the solvent is an isoparrafin type hydrocarbon.

16. A liquid developer according to claim 1 wherein said electrically-insulating carrier liquid is selected from the group consisting of aliphatic hydrocarbons, aromatic hydrocarbons and halogenated hydrocarbons.

17. A process for preparing a liquid developer for electrophotography which comprises dissolving at least one rubber selected from the group consisting of natural rubber, styrene-butadiene rubber and vinyltoluene-butadiene rubber in a solvent having a boiling point range of 150° to 200° C; heating the resulting solution at a temperature of 150° to 200° C for 10 to 60 minutes; kneading a mixture of the resulting rubber solution and colored particles and dispersing the kneaded material in an electrically-insulating carrier liquid having a volume resistivity not lower than $10^9$ ohm-cm and a dielectric constant not higher than 3.

18. A process for preparing a liquid developer according to claim 17, in which the colored particles comprise fine powder prepared by kneading (1) a dye or a pigment and (2) a resin having a softening point of 50° to 130° C and which is insoluble in the carrier liquid.

19. A process for preparing a liquid developer according to claim 17 wherein said electrically-insulating carrier liquid is selected from the group consisting of aliphatic hydrocarbons, aromatic hydrocarbons and halogenated hydrocarbons.

* * * * *

UNITED STATES PATENT OFFICE

CERTIFICATE OF CORRECTION

Patent No. 3,998,746 Dated December 21, 1976

Inventor(s) TERUKUNI TSUNEDA

It is certified that error appears in the above-identified patent and that said Letters Patent are hereby corrected as shown below:

At column 1, line 52, "corbon" should read --carbon--.

At column 4, about line 19, insert --Seikalight Blue A 612 (C.I. 74200)-- between "Seikalight Rose R-40(C.I.45160)" and "Seikalight Blue 2B 615(C.I. 74200)".

At column 4, line 57, "or" should read --of--.

At column 6, after the matter between the lines at about lines 32 - 36 and before line 39, insert --¶With a ball mill, 150 g of the above dispersed mixture--.

At column 10, bring together the headings in the table, as follows:

| | | |
|---|---|---|
| "Immediately after the preparation of the liquid developer" | and | "After the storage of the liquid developer for one month" |

At column 11, line 36, delete "In", first occurrence.

At column 12, lines 65-66, delete "after the drying"; and after the comma in line 66 and before "was prepared", insert --so that an electrophotographic sensitive paper--.

Signed and Sealed this

Twenty-second Day of March 1977

[SEAL]

*Attest:*

RUTH C. MASON
*Attesting Officer*

C. MARSHALL DANN
*Commissioner of Patents and Trademarks*